US012760454B2

(12) United States Patent
Li et al.

(10) Patent No.: US 12,760,454 B2
(45) Date of Patent: Oct. 13, 2026

(54) FIBER COMPOSITE MATERIAL, AND PREPARATION METHOD AND USE THEREOF

(71) Applicant: SHENZHEN SMOORE TECHNOLOGY LIMITED, Shenzhen (CN)

(72) Inventors: Xin Li, Shenzhen (CN); Dali Feng, Shenzhen (CN); Yu Zhou, Shenzhen (CN); Wei Li, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 402 days.

(21) Appl. No.: 18/358,048

(22) Filed: Jul. 25, 2023

(65) Prior Publication Data

US 2024/0044058 A1 Feb. 8, 2024

(30) Foreign Application Priority Data

Aug. 3, 2022 (CN) ..... 202210927172.8

(51) Int. Cl.
*D04H 1/46* (2012.01)
*A24F 40/10* (2020.01)
*A24F 40/48* (2020.01)

(52) U.S. Cl.
CPC ..... *D04H 1/46* (2013.01); *A24F 40/10* (2020.01); *A24F 40/48* (2020.01); *D10B 2201/20* (2013.01); *D10B 2331/04* (2013.01); *D10B 2331/14* (2013.01); *D10B 2401/022* (2013.01); *D10B 2401/04* (2013.01)

(58) Field of Classification Search
CPC . A24F 40/44; B32B 23/00–22; B32B 27/281; B32B 5/26–2795; A61M 15/06
See application file for complete search history.

(56) References Cited

U.S. PATENT DOCUMENTS

| | | | | |
|---|---|---|---|---|
| 8,857,446 | B2 | 10/2014 | Wu | |
| 10,842,199 | B2 | 11/2020 | Althorpe et al. | |
| 11,278,687 | B2 | 3/2022 | Sudlow et al. | |
| 2013/0340613 | A1* | 12/2013 | Krupnikov ..... | B01D 39/18 264/413 |

(Continued)

FOREIGN PATENT DOCUMENTS

| | | | |
|---|---|---|---|
| CN | 101929034 | A | 12/2010 |
| CN | 205340823 | U | 6/2016 |

(Continued)

OTHER PUBLICATIONS

"JP2012167894_Machine Translation" is a machine translation of JP-2012167894-A. (Year: 2012).*

(Continued)

*Primary Examiner* — Larissa Rowe Emrich
(74) *Attorney, Agent, or Firm* — Leydig, Voit & Mayer, Ltd.

(57) ABSTRACT

A fiber composite material includes: a heat resistant layer and a liquid guiding layer that are stacked. A material of the heat resistant layer includes a heat resistant fiber and a hydrophilic fiber. A material of the liquid guiding layer includes a hydrophilic fiber. The heat resistant fiber includes a polyimide fiber. The hydrophilic fiber includes a Tencel fiber.

18 Claims, 4 Drawing Sheets

(56) References Cited

U.S. PATENT DOCUMENTS

| | | | | |
|---|---|---|---|---|
| 2017/0035109 | A1* | 2/2017 | Liu | A24F 40/42 |
| 2018/0177240 | A1* | 6/2018 | Duque | A24F 40/44 |
| 2019/0001077 | A1* | 1/2019 | Xu | A24F 40/44 |

FOREIGN PATENT DOCUMENTS

| | | | | | |
|---|---|---|---|---|---|
| CN | 108499221 | A | | 9/2018 | |
| CN | 109198725 | A | | 1/2019 | |
| CN | 109355806 | A | | 2/2019 | |
| CN | 211861808 | U | | 11/2020 | |
| CN | 112477351 | A | | 3/2021 | |
| CN | 112931974 | A | | 6/2021 | |
| CN | 113106786 | A | * | 7/2021 | D21F 11/00 |
| CN | 214386078 | U | | 10/2021 | |
| CN | 214386079 | U | | 10/2021 | |
| CN | 113735555 | A | | 12/2021 | |
| CN | 215873462 | U | | 2/2022 | |
| CN | 114176258 | A | | 3/2022 | |
| CN | 114732166 | A | | 7/2022 | |
| JP | 2012167894 | A | * | 9/2012 | |
| JP | 202255295 | A | | 4/2022 | |

OTHER PUBLICATIONS

"CN113106786_Machine Translation" is a machine translation of CN-113106786-A. (Year: 2021).*

Patent Cooperation Treaty, International Search Report and Written Opinion, International Application No. PCT/CN2022/112887 (Dec. 20, 2022).

Chinese Patent Office, Office Action in Chinese Patent Application No. 202210927172.8 (Apr. 10, 2023).

European Patent Office, Search Report in European Patent Application No. 23186897.7 (Dec. 21, 2023).

Chinese Patent Office, Office Action in Chinese Patent Application No. 202210927172.8 (Sep. 29, 2023).

* cited by examiner

FIBER COMPOSITE MATERIAL, AND PREPARATION METHOD AND USE THEREOF

CROSS-REFERENCE TO PRIOR APPLICATION

Priority is claimed to Chinese Patent Application No. 202210927172.8, filed on Aug. 3, 2022, the entire disclosure of which is hereby incorporated by reference herein.

FIELD

The present invention relates to the technical field of liquid-guiding materials of e-cigarettes, and specifically, to a fiber composite material, and a preparation method and use thereof.

BACKGROUND

On the current market, an aerosol generation device of a vaporization core material used in an e-cigarette is mainly composed of a vaporization core and an e-liquid tank. The vaporization core is a core part of the aerosol generation device. The vaporization core is composed of a porous material and a heating element. The porous material supplies an e-liquid to the heating element, which has an important impact on performance of the e-cigarette, such as an amount of smoke generated, a particle size of smoke, and a transmission efficiency of flavors and nicotine. At present, there are mainly two types of liquid-guiding materials used in a vaporization core. One is a cotton core including natural cotton and synthetic fibers, and the other is a porous liquid-guiding ceramic. The porous liquid-guiding ceramic has excellent heat resistance, but has a limited liquid-guiding rate. Therefore, the cotton core is still the mainstream liquid-guiding material. In the related art, there is a composite material obtained from cotton fibers, flax fibers, non-woven fabrics, and the like by using a spunlacing process. Although the composite material in actual use can better implement liquid locking and storage, actual requirements on liquid guiding performance still cannot be satisfied. Therefore, it is necessary to develop a fiber composite material with high liquid guiding performance.

SUMMARY

In an embodiment, the present invention provides a fiber composite material, comprising: a heat resistant layer and a liquid guiding layer that are stacked, wherein a material of the heat resistant layer comprises a heat resistant fiber and a hydrophilic fiber, wherein a material of the liquid guiding layer comprises a hydrophilic fiber, wherein the heat resistant fiber comprises a polyimide fiber, and wherein the hydrophilic fiber comprises a Tencel fiber.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
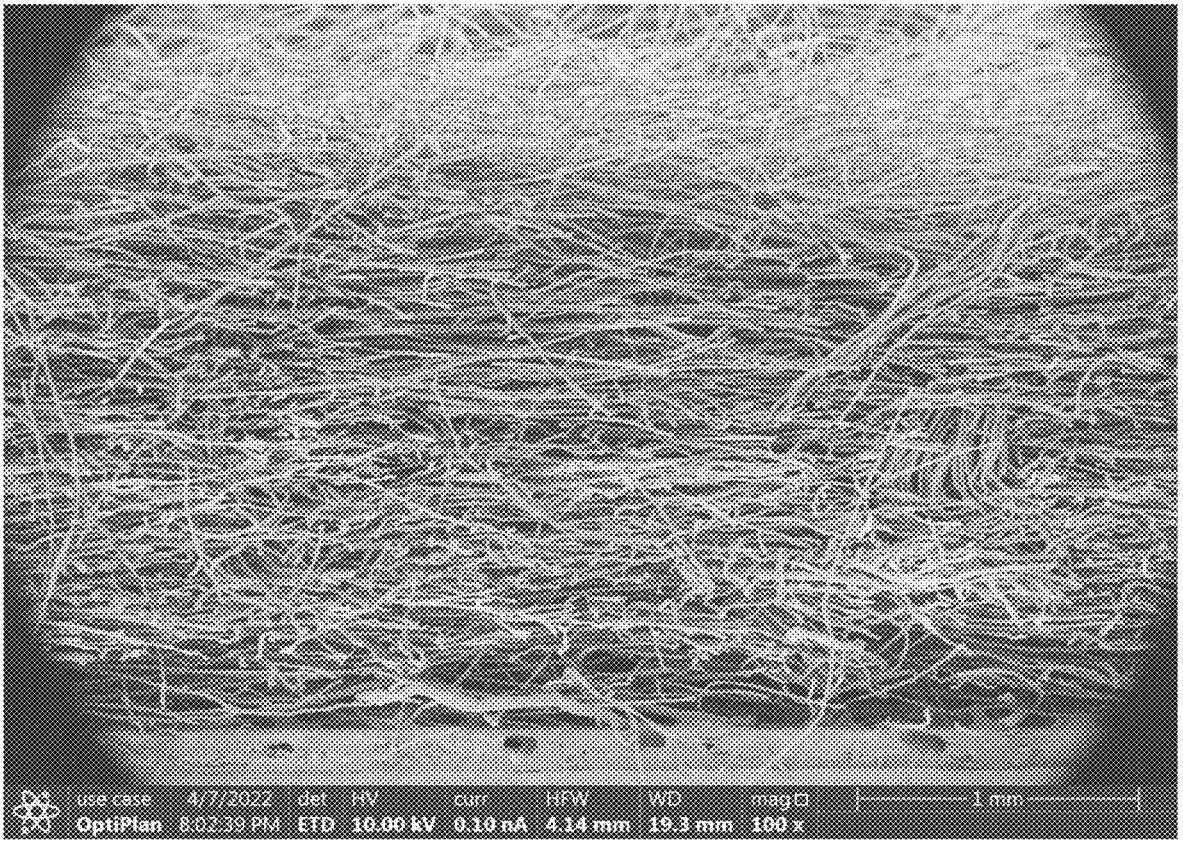
FIG. 1 is an SEM micrograph of an overall cross section of a fiber composite material prepared in Example 1.

In an embodiment, the present invention overcomes the defect that an existing fiber composite material has limited liquid guiding performance and cannot effectively satisfy actual requirements, and further provide a fiber composite material, and a preparation method and use thereof.

In an embodiment, the present invention provides the following technical solutions.

In an embodiment, the present invention provides a fiber composite material. The fiber composite material includes a heat resistant layer and a liquid guiding layer that are stacked.

A material of the heat resistant layer includes a heat resistant fiber and a hydrophilic fiber, a material of the liquid guiding layer includes a hydrophilic fiber, the heat resistant fiber includes a polyimide fiber, and the hydrophilic fiber includes a Tencel fiber. It may be understood that the material of the heat resistant layer includes the polyimide fiber and the Tencel fiber, and the material of the liquid guiding layer includes the Tencel fiber.

Preferably, based on the total weight of the material of the heat resistant layer, a weight proportion of the heat resistant fiber is 20-80%, and a weight proportion of the hydrophilic fiber is 20-80%.

Preferably, the heat resistant fiber further includes at least one of a polyphenylene sulfide fiber, an aramid fiber, a polytetrafluoroethylene fiber, a carbon fiber, a metal fiber, a poly(p-phenylene-2,6-benzobisoxazole) (PBO) fiber, and a poly[2,2'-(m-phenylen)-5,5'-bisbenzimidazole] (PBI) fiber; and the hydrophilic fiber further includes at least one of a cotton fiber, a flax fiber, a hemp fiber, a Modal fiber, a cuprammonium rayon fiber, a bamboo fiber, a seaweed fiber, a chitosan fiber, and a carboxymethyl cellulose fiber. When the heat resistant fiber further includes at least one of a polyphenylene sulfide fiber, an aramid fiber, a polytetrafluoroethylene fiber, a carbon fiber, a metal fiber, a poly(p-phenylene-2,6-benzobisoxazole) (PBO) fiber, and a poly[2,2'-(m-phenylen)-5,5'-bisbenzimidazole] (PBI) fiber, a ratio of the polyimide fiber to the foregoing fiber is not specifically limited in the present invention. Optionally, a mass ratio of the polyimide fiber to the foregoing fiber may be (1-10):1. When the hydrophilic fiber further includes at least one of a cotton fiber, a flax fiber, a hemp fiber, a Modal fiber, a cuprammonium rayon fiber, a bamboo fiber, a seaweed fiber, a chitosan fiber, and a carboxymethyl cellulose fiber, a ratio of the Tencel fiber to the foregoing fiber is not specifically limited in the present invention. Optionally, a mass ratio of the Tencel fiber to the foregoing fiber may be (1-10):1.

Preferably, the material of the heat resistant layer and/or liquid guiding layer further includes a high resilience fiber, preferably, the high resilience fiber includes a hollow polyester fiber, further preferably, the hollow polyester fiber is a three-dimensional crimped hollow polyester fiber.

The heat resistant fiber, the hydrophilic fiber, and the high resilience fiber in the present invention are all existing conventional fiber materials, which are commercially available. For example, the polyimide fiber is referred to as a PI fiber for short and is also referred to as an aromatic polyimide fiber, which is a commercially available fiber material common in the art.

Preferably, based on the total weight of the material of the heat resistant layer, a weight proportion of the heat resistant fiber is 19.9-80%, a weight proportion of the hydrophilic fiber is 19.9-80%, and a weight proportion of the high resilience fiber is 0.1-20%; and based on the total weight of the material of the liquid guiding layer, a weight proportion of the hydrophilic fiber is 50-99.9%, and a weight proportion of the high resilience fiber is 0.1-50%.

Preferably, based on the total weight of the material of the heat resistant layer, a weight proportion of the heat resistant fiber is 20-60%, a weight proportion of the hydrophilic fiber is 20-60%, and a weight proportion of the high resilience fiber is 10-20%; and based on the total weight of the material of the liquid guiding layer, a weight proportion of the hydrophilic fiber is 80-90%, and a weight proportion of the high resilience fiber is 10-20%. In the present invention, the control of the amount of the high resilience fiber and the amount of the heat resistant fiber and the hydrophilic fiber can improve liquid guiding performance of the composite material and improve liquid storage and locking of the material.

Preferably, the porosity of the heat resistant layer is 70-98%, and the porosity of the liquid guiding layer is 50-82%.

Preferably, the thickness of the heat resistant layer is 30-60% of the total thickness of the heat resistant layer and the liquid guiding layer; and the grammage of the heat resistant layer is 30-60% of the total grammage of the heat resistant layer and the liquid guiding layer.

Preferably, the total thickness of the heat resistant layer and the liquid guiding layer is 0.9-1.8 mm, and the total grammage of the heat resistant layer and the liquid guiding layer is 180-300 g/m$^2$.

Preferably, the length of the heat resistant fiber is 38-60 mm, the fineness of the heat resistant fiber is 0.8-7.0 D, the length of the hydrophilic fiber is 28-60 mm, the fineness of the hydrophilic fiber is 0.9-2.5 D, the length of the high resilience fiber is 38-60 mm, and the fineness of the high resilience fiber is 3-10 D. It may be understood that the unit D of the fineness is denier. More preferably, a profiled cross section is selected to be a cross section of the heat resistant fiber or the hydrophilic fiber, such as a trilobal shape or a cross shape, so as to improve liquid guiding performance of the fiber. It may be understood that the unit of the fineness is denier, abbreviated D, which is a unit of measure for the thickness of fibers. A higher value in deniers indicates a thicker fiber. Preferably, the length of the heat resistant fiber is 50-60 mm, the fineness of the heat resistant fiber is 0.8-1 D, the length of the hydrophilic fiber is 50-60 mm, and the fineness of the hydrophilic fiber is 0.9-1.0 D. In the present invention, the control of the length and fineness of the heat resistant fiber and the hydrophilic fiber can improve liquid guiding performance of the composite material and improve liquid storage and locking of the material.

Optionally, an average pore size of the fiber composite material is 40-70 μm, and the porosity of the fiber composite material is 60-90%.

The present invention further provides a preparation method of the fiber composite material, including: preparing the fiber composite material by using a needling process.

Preferably, the preparation method includes the following steps:

(1) opening, mixing, and carding the material of the heat resistant layer to obtain a mono-layer-fibrous web thin ply material, laying a plurality of mono-layer-fibrous web thin ply materials together to form a fibrous web material, and needling the fibrous web material to entangle fibers for shaping, to obtain a semi-fabricated fibrous web for heat resistant layer;

(2) opening, mixing, and carding the material of the liquid guiding layer to obtain a mono-layer-fibrous web thin ply material, laying a plurality of mono-layer-fibrous web thin ply materials together to form a fibrous web material, and needling the fibrous web material to entangle fibers for shaping, to obtain a semi-fabricated fibrous web for liquid guiding layer; and (3) bonding the semi-fabricated fibrous web for heat resistant layer and the semi-fabricated fibrous web for liquid guiding layer together by needling, and carrying out hot rolling, to obtain the fiber composite material.

Preferably, in step (1), the grammage of the mono-layer-fibrous web thin ply material is 5-20 g/m$^2$, the thickness of the fibrous web material is 4-15 cm, the step of needling to entangle fibers for shaping includes sequentially carrying out a pre-needling process and a backward needling process on the fibrous web material, preferably, in the pre-needling process, the density of needles arranged on a needle plate is 2000-4000 needles/m, the needling frequency is 350-450 times/min, and the needling depth is 1.5-2.0 mm; and in the backward needling process, the density of needles arranged on a needle plate is 3000-5000 needles/m, the needling frequency is 390-500 times/min, and the needling depth is 1.9-2.5 mm. Further preferably, in the pre-needling process, the density of needles arranged on a needle plate is 3500 needles/m, the needling frequency is 400 times/min, and the needling depth is 1.5-2.0 mm; and in the backward needling process, the density of needles arranged on a needle plate is 4000 needles/m, the needling frequency is 440 times/min, and the needling depth is 1.9-2.5 mm.

In step (2), the grammage of the mono-layer-fibrous web thin ply material is 10-30 g/m$^2$, the thickness of the fibrous web material is 11-16 cm, the step of needling to entangle fibers for shaping includes sequentially carrying out a pre-needling process and a backward needling process on the fibrous web material, preferably, in the pre-needling process, the density of needles arranged on a needle plate is 2000-4000 needles/m, the needling frequency is 400-500 times/min, and the needling depth is 2.0-2.5 mm; and in the backward needling process, the density of needles arranged on a needle plate is 3000-5000 needles/m, the needling frequency is 450-550 times/min, and the needling depth is 2.5-3.0 mm. Further preferably, in the pre-needling process, the density of needles arranged on a needle plate is 3500 needles/m, the needling frequency is 450 times/min, and the needling depth is 2.0-2.5 mm; and in the backward needling process, the density of needles arranged on a needle plate is 4000 needles/m, the needling frequency is 500 times/min, and the needling depth is 2.5-3.0 mm.

In step (3), the step of needling includes a step of forward needling and a step of backward needling, preferably, in the step of forward needling, the density of needles arranged on a needle plate is 10000-15000 needles/m, the needling frequency is 1000-1400 times/min, and the needling depth is 1.0-2.0 mm; in the step of backward needling, the density of needles arranged on a needle plate is 12000-16000 needles/m, the needling frequency is 1000-1400 times/min, and the needling depth is 0.9-2.5 mm; further preferably, in the step of forward needling, the density of needles arranged on a needle plate is 12000 needles/m, the needling frequency is 1200 times/min, and the needling depth is 1.0-1.5 mm; and in the step of backward needling, the density of needles arranged on a needle plate is 14000 needles/m, the needling frequency is 1300 times/min, and the needling depth is 0.9-1.6 mm. Optionally, the material of the heat resistant layer is arranged to be first in contact with the needles.

The hot rolling is carried out by using a three-roller calender with a speed controlled to 20-50 m/min, a distance between rollers controlled to 0.9-1.8 mm, and a hot rolling temperature controlled to 160-180° C.

Step (3) further includes a step of winding the fiber composite material to form a coil, after the hot rolling.

The present invention further provides a liquid guiding element. A material of the liquid guiding element is the fiber composite material above or the fiber composite material obtained by using the preparation method above.

The present invention further provides a heating assembly, including the fiber composite material above and a heating body in contact with the heat resistant layer.

The present invention further provides a vaporizer, including the heating assembly above.

The present invention further provides an electronic vaporization device, including the vaporizer above.

Beneficial effects of the present invention are as follows:

(1) The fiber composite material provided in the present invention includes a heat resistant layer and a liquid guiding layer that are stacked. The material of the heat resistant layer includes a polyimide fiber and a Tencel fiber. The polyimide fiber has low thermal conduction performance, which contributes to heat loss of heating wires during vaporization. As the viscosity of an e-liquid decreases at high temperatures, fluidity of the e-liquid absorbed by the Tencel fiber is improved, so that the e-liquid is more uniformly distributed in the composite material. In addition, the material of the liquid guiding layer includes a Tencel fiber, so that the e-liquid can be fully supplied on a surface of the polyimide fiber, which is conducive to improving liquid storage and locking of the entire composite material. In the present invention, by providing the specific polyimide fiber and Tencel fiber in the heat resistant layer and cooperating with the Tencel fiber in the liquid guiding layer, the liquid guiding performance of the composite material can be greatly improved; and moreover, the obtained composite material also has similar or even higher liquid storage and locking performance than an existing liquid guiding material.

In addition, the polyimide fiber has very excellent heat resistance and does not change in physical properties during long-term use at high temperatures. As a skeleton material of the heat resistant layer, the polyimide fiber can better maintain dimensional stability of the material. The Tencel fiber has better liquid absorbing and locking performance than a cotton fiber, which ensures that the heat resistant layer has sufficient liquid storage capacity, and prevents dry burning (at 800-1000° C.) or even being burnt. The specific materials of the heat resistant layer and the liquid guiding layer can ensure that there is sufficient supply of the e-liquid even in continuous use, so that the performance of liquid guiding, storage, and locking does not decrease much, and taste consistency can be maintained for a longer period of time. Moreover, the obtained composite material has excellent heat resistance and service life, as well as better resistance to e-liquid erosion. Long-term use of the composite material rarely causes degradation and deterioration to form harmful oligomers, reducing miscellaneous odors.

(2) The material of the heat resistant layer and/or liquid guiding layer in the present invention further includes a high resilience fiber. The fiber has very clear elastic recovery. Even if the fiber is soaked in a high-viscosity e-liquid, a high-porosity structure of non-woven fabric obtained through needling can be ensured, so that the performance of liquid guiding, storage, and locking of the composite material in use does not decrease, but increases.

(3) In the present invention, the heat resistant fiber further includes at least one of a polyphenylene sulfide fiber, an aramid fiber, a polytetrafluoroethylene fiber, a carbon fiber, a metal fiber, a poly(p-phenylene-2,6-benzobisoxazole) fiber, and a poly[2,2'-(m-phenylen)-5,5'-bisbenzimidazole] fiber; and the hydrophilic fiber further includes at least one of a cotton fiber, a flax fiber, a hemp fiber, a Modal fiber, a cuprammonium rayon fiber, a bamboo fiber, a seaweed fiber, a chitosan fiber, and a carboxymethyl cellulose fiber. In the present invention, the selection of the foregoing materials is conducive to improving the liquid guiding performance of the composite material, can ensure that the composite material has similar or even higher liquid storage and locking performance than an existing liquid guiding material, and can satisfy different performance requirements of products. For example, the introduction of the metal fiber or carbon fiber is conducive to improving vaporization efficiency of the e-liquid, and can obtain the performance of liquid storage, locking, and guiding required by common cotton materials. The introduction of the seaweed fiber, chitosan fiber, and carboxymethyl cellulose fiber is conducive to reducing leakage of products.

The following examples are provided to further understand the present invention, are not limited to the optimal implementation, and do not limit the content and protection scope of the present invention. Any product identical or similar to the present invention obtained by anyone under the inspiration of the present invention or by combining the present invention with features of other existing technologies falls within the protection scope of the present invention.

The examples in which specific experimental steps or conditions are not indicated shall be carried out in accordance with operations or conditions of common experimental steps described in the literature in the art. The reagents or instruments used without indicating the manufacturer are all common reagent products commercially available from the market.

It needs to be noted that the fineness and length of a fiber involved in the following examples or comparative examples of the present invention are indicated in the form of brackets. For example, in example 1, polyimide fiber (2.0 D×51 mm) indicates that the fineness of the polyimide fiber is 2.0 D and the length of the polyimide fiber is 51 mm.

The thickness and grammage of a fiber composite material involved in the following examples are measured by using the following method.

The thickness of a fiber composite material is measured using a micrometer thickness gauge (BK-3281, measurement diameter: 10 mm). A measurement area is 3 m×0.5 m.

The thickness is measured at 20 points in a width direction of the fiber composite material and then averaged.

Measurement of grammage: 10 pieces are randomly sampled from a 3 m×0.5 m fiber composite material and respectively cut into 100 $cm^2$ circles, prior to weighing and averaging.

Example 1

This example provides a fiber composite material, and a preparation method thereof includes the following steps.

(1) 400 kg of polyimide fibers (2.0 D×51 mm) and 600 kg of Tencel fibers (1.5 D×38 mm) were fed into a coarse opener at a rotational speed of 1250 r/min, to pre-opening the lumpy crimped and compacted fibers. The pre-opened fibers were fed into a cotton mixing warehouse for mixing and then carded by cotton feeding rollers of a carding machine into a 10 $g/m^2$ mono-layer-fibrous web thin ply material. Multiple mono-layer-fibrous web thin ply materials were laid together to form a fibrous web material (with the thickness of 12 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 400 times/min, and the needling depth is 1.7 mm. In the backward needling process, the density of needles arranged on a needle plate is 4000 needles/m, the needling frequency is 440 times/min, and the needling depth is 2.1 mm. Finally, a semi-fabricated fibrous web for heat resistant layer was obtained.

(2) 1000 kg of Tencel fibers (1.5 D×38 mm) were fed into a coarse opener at a rotational speed of 1540 r/min, to pre-opening the lumpy crimped and compacted fibers. The pre-opened fibers were fed into a cotton mixing warehouse for mixing and then carded by cotton feeding rollers of a carding machine into a 20 $g/m^2$ mono-layer-fibrous web thin ply material. Multiple mono-layer-fibrous web thin ply materials were laid together to form a fibrous web material (with the thickness of 15 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 450 times/min, and the needling depth is 2.2 mm. In the backward needling process, the density of needles arranged on a needle plate is 4000 needles/m, the needling frequency is 500 times/min, and the needling depth is 2.7 mm. Finally, a semi-fabricated fibrous web for liquid guiding layer was obtained.

(3) The semi-fabricated fibrous web for heat resistant layer and the semi-fabricated fibrous web for liquid guiding layer were fed through double channels into a forward needling machine for repeated needling, and then fed into a backward needling machine for needling, so that the semi-fabricated fibrous web for heat resistant layer and the semi-fabricated fibrous web for liquid guiding layer were entangled and fixed together. In the step of forward needling, the density of needles arranged on a needle plate is 12000 needles/m, the needling frequency is 1200 times/min, and the needling depth is 1.3 mm. In the step of backward needling, the density of needles arranged on a needle plate is 14000 needles/m, the needling frequency is 1300 times/min, and the needling depth is 1.3 mm. Hot rolling was carried out by using a three-roller calender with a speed controlled to 20 m/min, a distance between rollers controlled to 1.3 mm, and a hot rolling temperature controlled to 180° C. After the hot rolling, the hot-rolled material was wound to form a coil to obtain the fiber composite material.

The fiber composite material prepared above includes a heat resistant layer and a liquid guiding layer that are stacked. The material of the heat resistant layer is the polyimide fiber and the Tencel fiber. The material of the liquid guiding layer is the Tencel fiber. Based on the total weight of the material of the heat resistant layer, a weight proportion of the polyimide fiber is 40%, and a weight proportion of the Tencel fiber is 60%. The porosity of the heat resistant layer is 78%. The porosity of the liquid guiding layer is 60%. The thickness of the heat resistant layer is 45% of the total thickness of the heat resistant layer and the liquid guiding layer. The grammage of the heat resistant layer is 45% of the total grammage of the heat resistant layer and the liquid guiding layer. The total thickness of the heat resistant layer and the liquid guiding layer is 1.5 mm. The total grammage of the heat resistant layer and the liquid guiding layer is 250 $g/m^2$.

Figure 5:
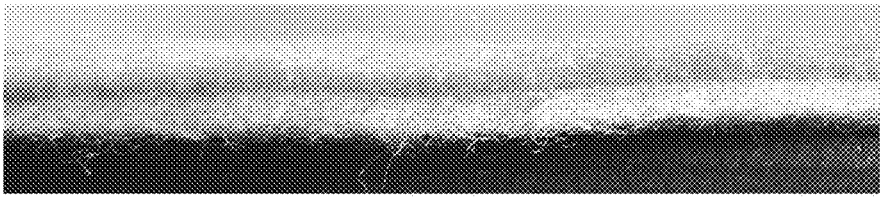
FIG. 5 is a photograph of a fiber composite material prepared in Example 1.

FIG. 1 is an SEM micrograph of an overall cross section of a fiber composite material prepared in Example 1. It can be learned from FIG. 1 that the upper layer is a loose and porous heat resistant layer, and the lower layer is a tight liquid guiding layer. FIG. 5 is a photograph of the fiber composite material prepared above. Its structure can be divided into two layers, the upper layer is the heat resistant layer (a mixture of the polyimide fiber and the Tencel fiber), and the lower layer is the liquid guiding layer (the Tencel fiber).

Figure 2:
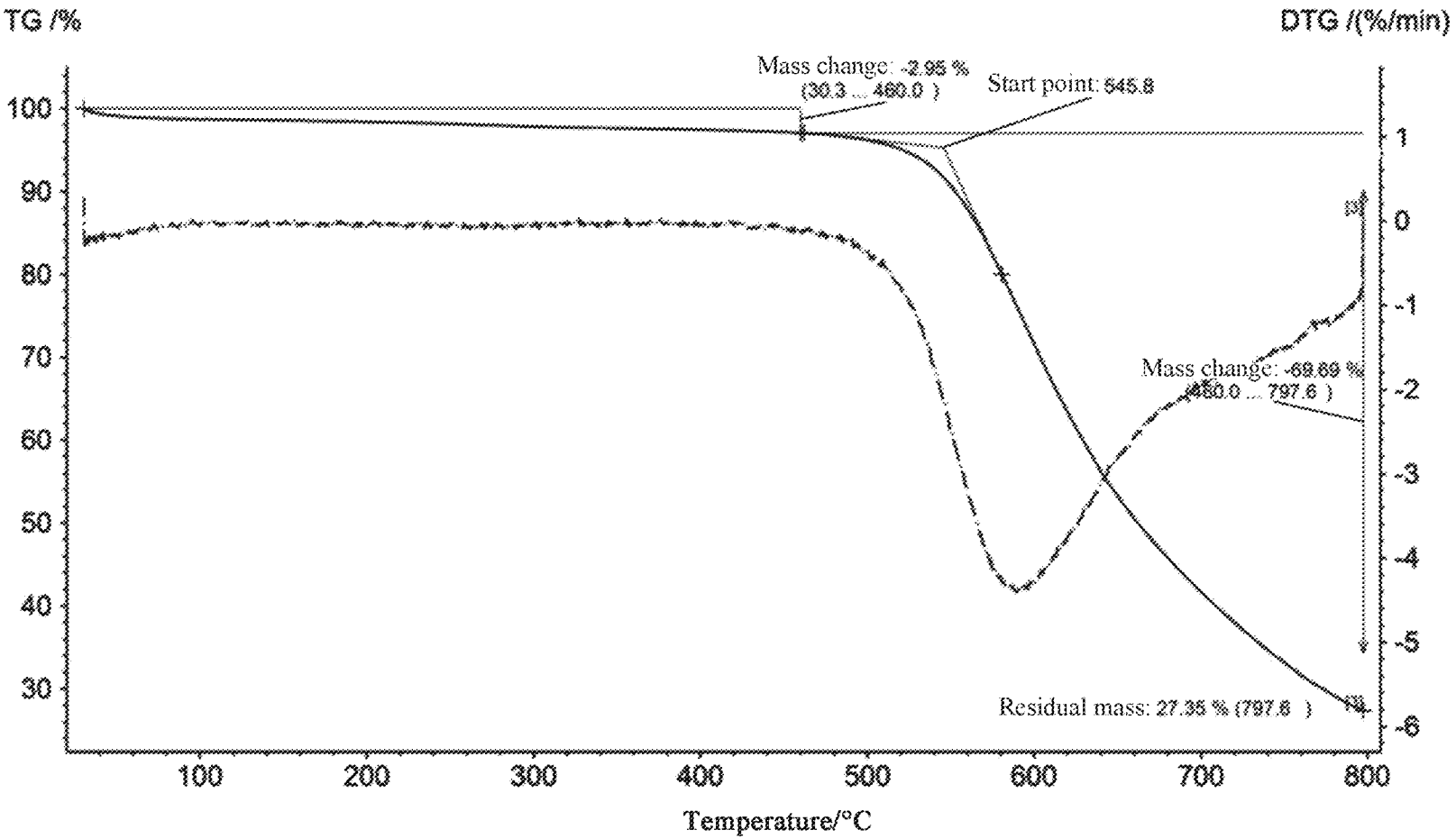
FIG. 2 shows a test result of heat resistance of a polyimide fiber used in Example 1 of the present invention.
Figure 3:
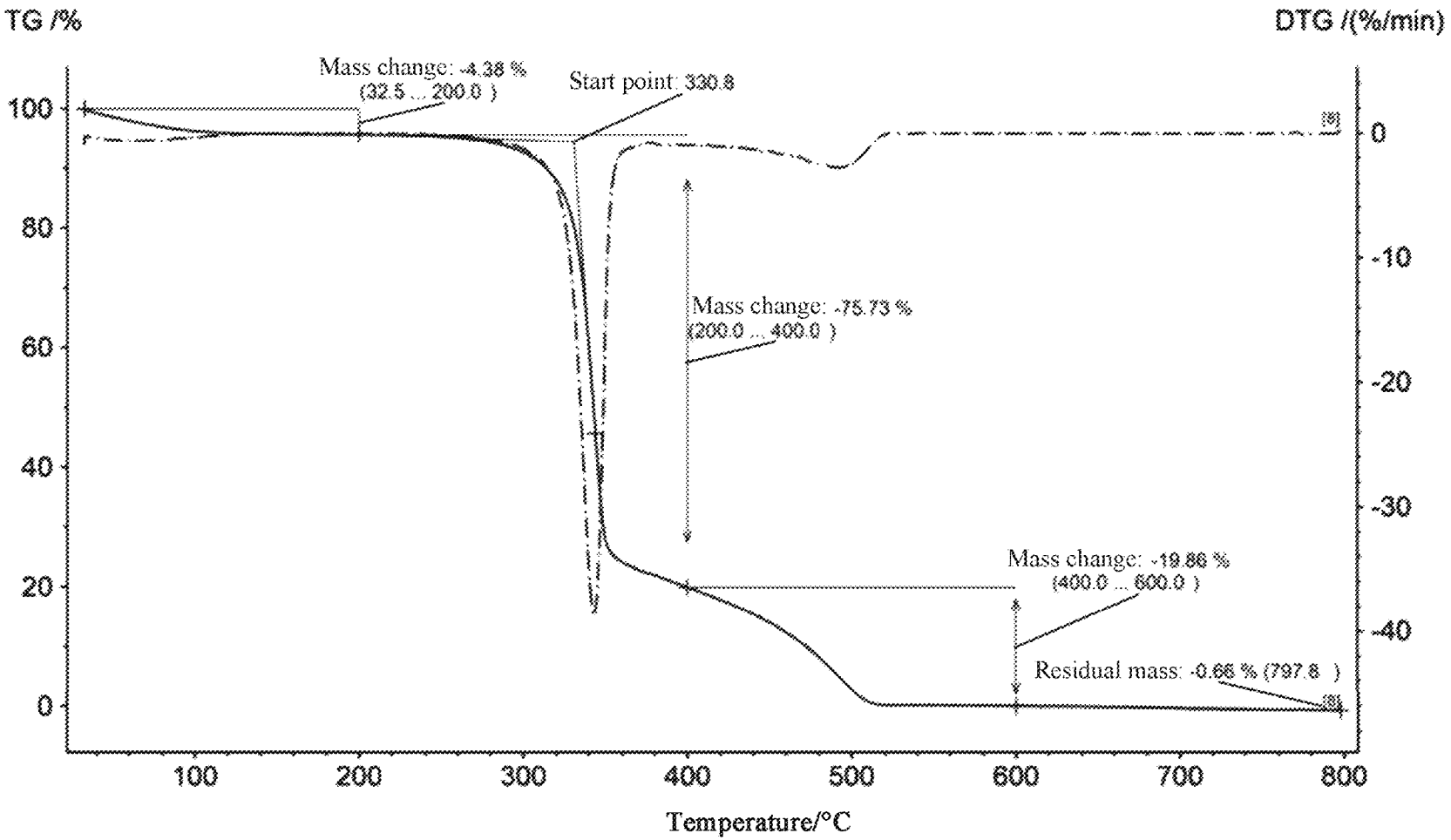
FIG. 3 shows a test result of heat resistance of a commercially available cotton fiber.

FIG. 2 shows a test result of heat resistance of the polyimide fiber used above. FIG. 3 shows a test result of heat resistance of a commercially available cotton fiber. It can be learned from FIG. 2 and FIG. 3 that the polyimide fiber has better heat resistance than the cotton fiber. The use of the polyimide fiber in the heat resistant layer of the present invention is more conducive to improving heat resistance of the composite material.

Figure 4:
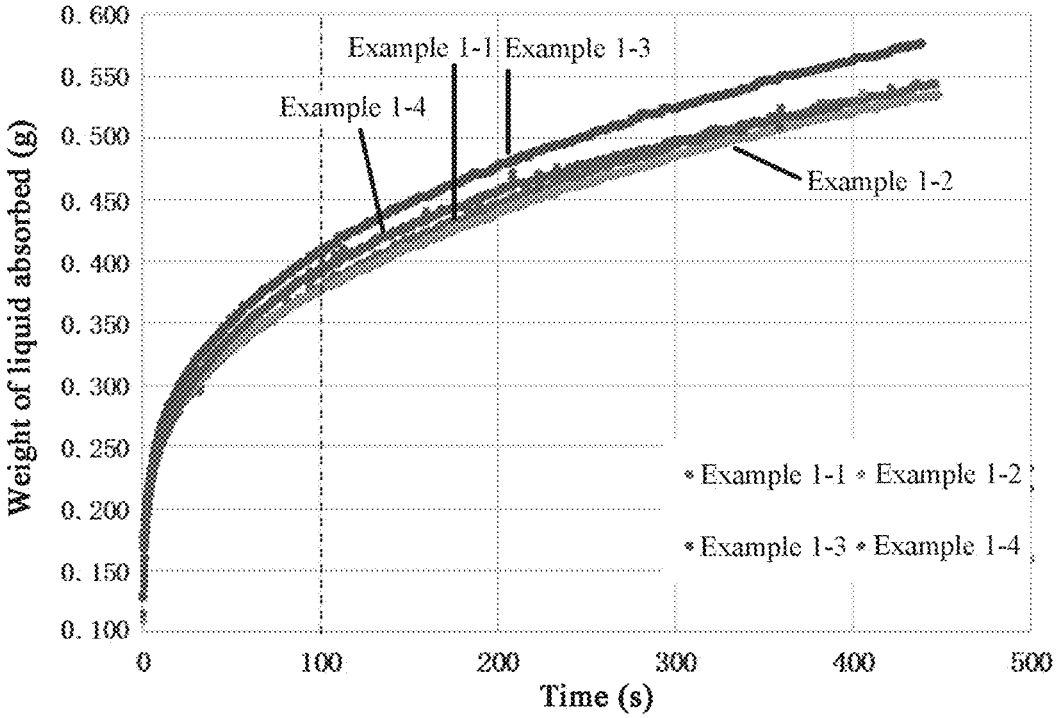
FIG. 4 shows a test result of liquid guiding performance of a fiber composite material prepared in Example 1.

FIG. 4 shows a test result of liquid guiding performance of the fiber composite material prepared in this example. The test was carried out with four samples in parallel, namely, Example 1-1, Example 1-2, Example 1-3, and Example 1-4. The test result is shown in FIG. 4.

Example 2

This example provides a fiber composite material, and a preparation method thereof includes the following steps.

(1) 800 kg of polyimide fibers (2.0 D×51 mm) and 200 kg of Tencel fibers (1.5 D×38 mm) were fed into a coarse opener at a rotational speed of 1250 r/min, to pre-opening the lumpy crimped and compacted fibers. The pre-opened fibers were fed into a cotton mixing warehouse for mixing and then carded by cotton feeding rollers of a carding machine into a 5 $g/m^2$ mono-layer-fibrous web thin ply material. Multiple mono-layer-fibrous web thin ply materials were laid together to form a fibrous web material (with the thickness of 4.5 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 350 times/min, and the needling depth is 1.5 mm. In the backward needling process, the density of needles arranged on a needle plate is 4000 needles/m, the needling frequency is 390 times/min, and the needling depth is 1.9 mm. Finally, a semi-fabricated fibrous web for heat resistant layer was obtained.

(2) 1000 kg of Tencel fibers (1.5 D×38 mm) were fed into a coarse opener at a rotational speed of 1540 r/min, to pre-opening the lumpy crimped and compacted fibers. The pre-opened fibers were fed into a cotton mixing warehouse for mixing and then carded by cotton feeding rollers of a carding machine into a 10 g/m$^2$ mono-layer-fibrous web thin ply material. Multiple mono-layer-fibrous web thin ply materials were laid together to form a fibrous web material (with the thickness of 11 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 400 times/min, and the needling depth is 2.0 mm. In the backward needling process, the density of needles arranged on a needle plate is 4000 needles/m, the needling frequency is 450 times/min, and the needling depth is 2.5 mm. Finally, a semi-fabricated fibrous web for liquid guiding layer was obtained.

(3) The semi-fabricated fibrous web for heat resistant layer and the semi-fabricated fibrous web for liquid guiding layer were fed through double channels into a forward needling machine for repeated needling, and then fed into a backward needling machine for needling, so that the semi-fabricated fibrous web for heat resistant layer and the semi-fabricated fibrous web for liquid guiding layer were entangled and fixed together. In the step of forward needling, the density of needles arranged on a needle plate is 12000 needles/m, the needling frequency is 1200 times/min, and the needling depth is 1.5 mm. In the step of backward needling, the density of needles arranged on a needle plate is 14000 needles/m, the needling frequency is 1300 times/min, and the needling depth is 1.6 mm. Hot rolling was carried out by using a three-roller calender with a speed controlled to 20 m/min, a distance between rollers controlled to 0.9 mm, and a hot rolling temperature controlled to 180° C. After the hot rolling, the hot-rolled material was wound to form a coil to obtain the fiber composite material.

The fiber composite material prepared above includes a heat resistant layer and a liquid guiding layer that are stacked. The material of the heat resistant layer is the polyimide fiber and the Tencel fiber. The material of the liquid guiding layer is the Tencel fiber. Based on the total weight of the material of the heat resistant layer, a weight proportion of the polyimide fiber is 80%, and a weight proportion of the Tencel fiber is 20%. The porosity of the heat resistant layer is 71%. The porosity of the liquid guiding layer is 50%. The thickness of the heat resistant layer is 30% of the total thickness of the heat resistant layer and the liquid guiding layer. The grammage of the heat resistant layer is 30% of the total grammage of the heat resistant layer and the liquid guiding layer. The total thickness of the heat resistant layer and the liquid guiding layer is 0.9 mm. The total grammage of the heat resistant layer and the liquid guiding layer is 180 g/m$^2$.

Example 3

This example provides a fiber composite material, and a preparation method thereof includes the following steps.

(1) 200 kg of polyimide fibers (2.0 D×51 mm) and 800 kg of Tencel fibers (1.5 D×38 mm) were fed into a coarse opener at a rotational speed of 1250 r/min, to pre-opening the lumpy crimped and compacted fibers. The pre-opened fibers were fed into a cotton mixing warehouse for mixing and then carded by cotton feeding rollers of a carding machine into a 20 g/m$^2$ mono-layer-fibrous web thin ply material. Multiple mono-layer-fibrous web thin ply materials were laid together to form a fibrous web material (with the thickness of 15 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 450 times/min, and the needling depth is 2.0 mm. In the backward needling process, the density of needles arranged on a needle plate is 4000 needles/m, the needling frequency is 490 times/min, and the needling depth is 2.4 mm. Finally, a semi-fabricated fibrous web for heat resistant layer was obtained.

(2) 1000 kg of Tencel fibers (1.5 D×38 mm) were fed into a coarse opener at a rotational speed of 1540 r/min, to pre-opening the lumpy crimped and compacted fibers. The pre-opened fibers were fed into a cotton mixing warehouse for mixing and then carded by cotton feeding rollers of a carding machine into a 30 g/m$^2$ mono-layer-fibrous web thin ply material. Multiple mono-layer-fibrous web thin ply materials were laid together to form a fibrous web material (with the thickness of 15 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 500 times/min, and the needling depth is 2.5 mm. In the backward needling process, the density of needles arranged on a needle plate is 4000 needles/m, the needling frequency is 450 times/min, and the needling depth is 3.0 mm. Finally, a semi-fabricated fibrous web for liquid guiding layer was obtained.

(3) The semi-fabricated fibrous web for heat resistant layer and the semi-fabricated fibrous web for liquid guiding layer were fed through double channels into a forward needling machine for repeated needling, and then fed into a backward needling machine for needling, so that the semi-fabricated fibrous web for heat resistant layer and the semi-fabricated fibrous web for liquid guiding layer were entangled and fixed together. In the step of forward needling, the density of needles arranged on a needle plate is 12000 needles/m, the needling frequency is 1200 times/min, and the needling depth is 2.0 mm. In the step of backward needling, the density of needles arranged on a needle plate is 14000 needles/m, the needling frequency is 1300 times/min, and the needling depth is 2.5 mm. Hot rolling was carried out by using a three-roller calender with a speed controlled to 20 m/min, a distance between rollers controlled to 1.8 mm, and a hot rolling temperature controlled to 180° C. After the hot rolling, the hot-rolled material was wound to form a coil to obtain the fiber composite material.

The fiber composite material prepared above includes a heat resistant layer and a liquid guiding layer that are stacked. The material of the heat resistant layer is the polyimide fiber and the Tencel fiber. The material of the liquid guiding layer is the Tencel fiber. Based on the total weight of the material of the heat resistant layer, a weight proportion of the polyimide fiber is 20%, and a weight proportion of the Tencel fiber is 80%. The porosity of the heat resistant layer is 78%. The porosity of the liquid guiding layer is 61%. The thickness of the heat resistant layer is 50% of the total thickness of the heat resistant layer and the liquid guiding layer. The grammage of the heat resistant layer is 50% of the total grammage of the heat resistant layer and the liquid guiding layer. The total thickness of the heat resistant layer and the liquid guiding layer is 1.8 mm. The total grammage of the heat resistant layer and the liquid guiding layer is 300 g/m$^2$.

Example 4

This example provides a fiber composite material, and a preparation method thereof includes the following steps.

(1) 300 kg of polyimide fibers (2.0 D×51 mm), 100 kg of three-dimensional crimped hollow polyester fibers (5 D×60 mm), and 600 kg of Tencel fibers (1.5 D×38 mm) were fed into a coarse opener at a rotational speed of 1250 r/min, to pre-opening the lumpy crimped and compacted fibers. The pre-opened fibers were fed into a cotton mixing warehouse for mixing and then carded by cotton feeding rollers of a carding machine into a 10 g/m$^2$ mono-layer-fibrous web thin ply material. Multiple mono-layer-fibrous web thin ply materials were laid together to form a fibrous web material (with the thickness of 10 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 400 times/min, and the needling depth is 2.0 mm. In the backward needling process, the density of needles arranged on a needle plate is 4000 needles/m, the needling frequency is 440 times/min, and the needling depth is 2.4 mm. Finally, a semi-fabricated fibrous web for heat resistant layer was obtained.

(2) 900 kg of Tencel fibers (1.5 D×38 mm) and 100 kg of three-dimensional crimped hollow polyester fibers (5 D×60 mm) were fed into a coarse opener at a rotational speed of 1540 r/min, to pre-opening the lumpy crimped and compacted fibers. The pre-opened fibers were fed into a cotton mixing warehouse for mixing and then carded by cotton feeding rollers of a carding machine into a 20 g/m$^2$ mono-layer-fibrous web thin ply material. Multiple mono-layer-fibrous web thin ply materials were laid together to form a fibrous web material (with the thickness of 15 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 450 times/min, and the needling depth is 2.5 mm. In the backward needling process, the density of needles arranged on a needle plate is 4000 needles/m, the needling frequency is 500 times/min, and the needling depth is 3.0 mm. Finally, a semi-fabricated fibrous web for liquid guiding layer was obtained.

(3) The semi-fabricated fibrous web for heat resistant layer and the semi-fabricated fibrous web for liquid guiding layer were fed through double channels into a forward needling machine for repeated needling, and then fed into a backward needling machine for needling, so that the semi-fabricated fibrous web for heat resistant layer and the semi-fabricated fibrous web for liquid guiding layer were entangled and fixed together. In the step of forward needling, the density of needles arranged on a needle plate is 12000 needles/m, the needling frequency is 1200 times/min, and the needling depth is 1.3 mm. In the step of backward needling, the density of needles arranged on a needle plate is 14000 needles/m, the needling frequency is 1300 times/min, and the needling depth is 1.3 mm. Hot rolling was carried out by using a three-roller calender with a speed controlled to 20 m/min, a distance between rollers controlled to 1.3 mm, and a hot rolling temperature controlled to 180° C. After the hot rolling, the hot-rolled material was wound to form a coil to obtain the fiber composite material.

The fiber composite material prepared above includes a heat resistant layer and a liquid guiding layer that are stacked. The material of the heat resistant layer is the polyimide fiber, the Tencel fiber, and the three-dimensional crimped hollow polyester fiber. The material of the liquid guiding layer is the Tencel fiber and the three-dimensional crimped hollow polyester fiber. Based on the total weight of the material of the heat resistant layer, a weight proportion of the polyimide fiber is 30%, a weight proportion of the Tencel fiber is 60%, and a weight proportion of the three-dimensional crimped hollow polyester fiber is 10%. Based on the total weight of the material of the liquid guiding layer, a weight proportion of the Tencel fiber is 90%, and a weight proportion of the three-dimensional crimped hollow polyester fiber is 10%. The porosity of the heat resistant layer is 85%. The porosity of the liquid guiding layer is 65%. The thickness of the heat resistant layer is 45% of the total thickness of the heat resistant layer and the liquid guiding layer. The grammage of the heat resistant layer is 45% of the total grammage of the heat resistant layer and the liquid guiding layer. The total thickness of the heat resistant layer and the liquid guiding layer is 1.5 mm. The total grammage of the heat resistant layer and the liquid guiding layer is 250 g/m$^2$.

Example 5

This example provides a fiber composite material, and a preparation method thereof includes the following steps.

(1) 300 kg of polyimide fibers (2.0 D×51 mm), 100 kg of three-dimensional crimped hollow polyester fibers (5 D×60 mm), and 600 kg of Tencel fibers (1.5 D×38 mm) were fed into a coarse opener at a rotational speed of 1250 r/min, to pre-opening the lumpy crimped and compacted fibers. The pre-opened fibers were fed into a cotton mixing warehouse for mixing and then carded by cotton feeding rollers of a carding machine into a 10 g/m$^2$ mono-layer-fibrous web thin ply material. Multiple mono-layer-fibrous web thin ply materials were laid together to form a fibrous web material (with the thickness of 12 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 400 times/min, and the needling depth is 1.7 mm. In the backward needling process, the density of needles arranged on a needle plate is 4000 needles/m, the needling frequency is 440 times/min, and the needling depth is 2.1 mm. Finally, a semi-fabricated fibrous web for heat resistant layer was obtained.

(2) 900 kg of Tencel fibers (1.5 D×38 mm) and 100 kg of three-dimensional crimped hollow polyester fibers (5 D×60 mm) were fed into a coarse opener at a rotational speed of 1540 r/min, to pre-opening the lumpy crimped and compacted fibers. The pre-opened fibers were fed into a cotton mixing warehouse for mixing and then carded by cotton feeding rollers of a carding machine into a 20 g/m$^2$ mono-layer-fibrous web thin ply material. Multiple mono-layer-fibrous web thin ply materials were laid together to form a fibrous web material (with the thickness of 15 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 450 times/min, and the needling depth is 2.2 mm. In the backward needling process, the density of needles arranged on a needle plate is 4000 needles/m, the needling frequency is 500 times/min, and the needling depth is 2.7 mm. Finally, a semi-fabricated fibrous web for liquid guiding layer was obtained.

(3) The semi-fabricated fibrous web for heat resistant layer and the semi-fabricated fibrous web for liquid guiding layer were fed through double channels into a forward needling machine for repeated needling, and then fed into a backward needling machine for needling, so that the semi-fabricated fibrous web for heat resistant layer and the semi-fabricated fibrous web for liquid guiding layer were entangled and fixed together. In the step of forward needling, the density of needles arranged on a needle plate is 12000 needles/m, the needling frequency is 1200 times/min, and the needling depth is 1.3 mm. In the step of backward needling, the density of needles arranged on a needle plate is 14000 needles/m, the needling frequency is 1300 times/min, and the needling depth is 1.3 mm. Hot rolling was carried out by using a three-roller calender with a speed controlled to 20 m/min, a distance between rollers controlled to 1.3 mm, and a hot rolling temperature controlled to 180° C. After the hot rolling, the hot-rolled material was wound to form a coil to obtain the fiber composite material.

The fiber composite material prepared above includes a heat resistant layer and a liquid guiding layer that are stacked. The material of the heat resistant layer is the polyimide fiber, the Tencel fiber, and the three-dimensional crimped hollow polyester fiber. The material of the liquid guiding layer is the Tencel fiber and the three-dimensional crimped hollow polyester fiber. Based on the total weight of the material of the heat resistant layer, a weight proportion of the polyimide fiber is 30%, a weight proportion of the Tencel fiber is 60%, and a weight proportion of the three-dimensional crimped hollow polyester fiber is 10%. Based on the total weight of the material of the liquid guiding layer, a weight proportion of the Tencel fiber is 90%, and a weight proportion of the three-dimensional crimped hollow polyester fiber is 10%. The porosity of the heat resistant layer is 82%. The porosity of the liquid guiding layer is 77%. The thickness of the heat resistant layer is 40% of the total thickness of the heat resistant layer and the liquid guiding layer. The grammage of the heat resistant layer is 40% of the total grammage of the heat resistant layer and the liquid guiding layer. The total thickness of the heat resistant layer and the liquid guiding layer is 1.62 mm. The total grammage of the heat resistant layer and the liquid guiding layer is 250 g/m$^2$.

Example 6

This example provides a fiber composite material, and a preparation method thereof includes the following steps.

(1) 200 kg of polyimide fibers (2.0 D×51 mm), 200 kg of three-dimensional crimped hollow polyester fibers (5 D×60 mm), and 600 kg of Tencel fibers (1.5 D×38 mm) were fed into a coarse opener at a rotational speed of 1250 r/min, to pre-opening the lumpy crimped and compacted fibers. The pre-opened fibers were fed into a cotton mixing warehouse for mixing and then carded by cotton feeding rollers of a carding machine into a 20 g/m$^2$ mono-layer-fibrous web thin ply material. Multiple mono-layer-fibrous web thin ply materials were laid together to form a fibrous web material (with the thickness of 14 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 450 times/min, and the needling depth is 2.0 mm. In the backward needling process, the density of needles arranged on a needle plate is 4000 needles/m, the needling frequency is 490 times/min, and the needling depth is 2.4 mm. Finally, a semi-fabricated fibrous web for heat resistant layer was obtained.

(2) 800 kg of Tencel fibers (1.5 D×38 mm) and 200 kg of three-dimensional crimped hollow polyester fibers (5 D×60 mm) were fed into a coarse opener at a rotational speed of 1540 r/min, to pre-opening the lumpy crimped and compacted fibers. The pre-opened fibers were fed into a cotton mixing warehouse for mixing and then carded by cotton feeding rollers of a carding machine into a 30 g/m$^2$ mono-layer-fibrous web thin ply material. Multiple mono-layer-fibrous web thin ply materials were laid together to form a fibrous web material (with the thickness of 16 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 500 times/min, and the needling depth is 2.5 mm. In the backward needling process, the density of needles arranged on a needle plate is 4000 needles/m, the needling frequency is 550 times/min, and the needling depth is 3.0 mm. Finally, a semi-fabricated fibrous web for liquid guiding layer was obtained.

(3) The semi-fabricated fibrous web for heat resistant layer and the semi-fabricated fibrous web for liquid guiding layer were fed through double channels into a forward needling machine for repeated needling, and then fed into a backward needling machine for needling, so that the semi-fabricated fibrous web for heat resistant layer and the semi-fabricated fibrous web for liquid guiding layer were entangled and fixed together. In the step of forward needling, the density of needles arranged on a needle plate is 12000 needles/m, the needling frequency is 1200 times/min, and the needling depth is 2.0 mm. In the step of backward needling, the density of needles arranged on a needle plate is 14000 needles/m, the needling frequency is 1300 times/min, and the needling depth is 2.5 mm. Hot rolling was carried out by using a three-roller calender with a speed controlled to 20 m/min, a distance between rollers controlled to 1.8 mm, and a hot rolling temperature controlled to 180° C. After the hot rolling, the hot-rolled material was wound to form a coil to obtain the fiber composite material.

The fiber composite material prepared above includes a heat resistant layer and a liquid guiding layer that are stacked. The material of the heat resistant layer is the polyimide fiber, the Tencel fiber, and the three-dimensional crimped hollow polyester fiber. The material of the liquid guiding layer is the Tencel fiber and the three-dimensional crimped hollow polyester fiber. Based on the total weight of the material of the heat resistant layer, a weight proportion of the polyimide fiber is 20%, a weight proportion of the Tencel fiber is 60%, and a weight proportion of the three-dimensional crimped hollow polyester fiber is 20%. Based on the total weight of the material of the liquid guiding layer, a weight proportion of the Tencel fiber is 80%, and a weight proportion of the three-dimensional crimped hollow polyester fiber is 20%. The porosity of the heat resistant layer is 98%. The porosity of the liquid guiding layer is 80%. The thickness of the heat resistant layer is 50% of the total thickness of the heat resistant layer and the liquid guiding layer. The grammage of the heat resistant layer is 50% of the total grammage of the heat resistant layer and the liquid guiding layer. The total thickness of the heat resistant layer and the liquid guiding layer is 1.8 mm. The total grammage of the heat resistant layer and the liquid guiding layer is 300 g/m$^2$.

Example 7

This example provides a fiber composite material, and a preparation method thereof includes the following steps.

(1) 200 kg of polyimide fibers (2.0 D×51 mm), 200 kg of three-dimensional crimped hollow polyester fibers (5 D×60 mm), and 600 kg of Tencel fibers (1.5 D×38 mm) were fed into a coarse opener at a rotational speed of 1250 r/min, to pre-opening the lumpy crimped and compacted fibers. The pre-opened fibers were fed into a cotton mixing warehouse for mixing and then carded by cotton feeding rollers of a carding machine into a 10 g/m$^2$ mono-layer-fibrous web thin ply material. Multiple mono-layer-fibrous web thin ply materials were laid together to form a fibrous web material (with the thickness of 12 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 400 times/min, and the needling depth is 1.7 mm. In the backward needling process, the density of needles arranged on a needle plate is 4000 needles/m, the needling frequency is 440 times/min, and the needling depth is 2.1 mm. Finally, a semi-fabricated fibrous web for heat resistant layer was obtained.

(2) 800 kg of Tencel fibers (1.5 D×38 mm) and 200 kg of three-dimensional crimped hollow polyester fibers (5 D×60 mm) were fed into a coarse opener at a rotational speed of 1540 r/min, to pre-opening the lumpy crimped and compacted fibers. The pre-opened fibers were fed into a cotton mixing warehouse for mixing and then carded by cotton feeding rollers of a carding machine into a 20 g/m$^2$ mono-layer-fibrous web thin ply material. Multiple mono-layer-fibrous web thin ply materials were laid together to form a fibrous web material (with the thickness of 15 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 450 times/min, and the needling depth is 2.2 mm. In the backward needling process, the density of needles arranged on a needle plate is 4000 needles/m, the needling frequency is 500 times/min, and the needling depth is 2.7 mm. Finally, a semi-fabricated fibrous web for liquid guiding layer was obtained.

(3) The semi-fabricated fibrous web for heat resistant layer and the semi-fabricated fibrous web for liquid guiding layer were fed through double channels into a forward needling machine for repeated needling, and then fed into a backward needling machine for needling, so that the semi-fabricated fibrous web for heat resistant layer and the semi-fabricated fibrous web for liquid guiding layer were entangled and fixed together. In the step of forward needling, the density of needles arranged on a needle plate is 12000 needles/m, the needling frequency is 1200 times/min, and the needling depth is 1.3 mm. In the step of backward needling, the density of needles arranged on a needle plate is 14000 needles/m, the needling frequency is 1300 times/min, and the needling depth is 1.3 mm. Hot rolling was carried out by using a three-roller calender with a speed controlled to 20 m/min, a distance between rollers controlled to 1.3 mm, and a hot rolling temperature controlled to 180° C. After the hot rolling, the hot-rolled material was wound to form a coil to obtain the fiber composite material.

The fiber composite material prepared above includes a heat resistant layer and a liquid guiding layer that are stacked. The material of the heat resistant layer is the polyimide fiber, the Tencel fiber, and the three-dimensional crimped hollow polyester fiber. The material of the liquid guiding layer is the Tencel fiber and the three-dimensional crimped hollow polyester fiber. Based on the total weight of the material of the heat resistant layer, a weight proportion of the polyimide fiber is 20%, a weight proportion of the Tencel fiber is 60%, and a weight proportion of the three-dimensional crimped hollow polyester fiber is 20%. Based on the total weight of the material of the liquid guiding layer, a weight proportion of the Tencel fiber is 80%, and a weight proportion of the three-dimensional crimped hollow polyester fiber is 20%. The porosity of the heat resistant layer is 81%. The porosity of the liquid guiding layer is 81%. The thickness of the heat resistant layer is 45% of the total thickness of the heat resistant layer and the liquid guiding layer. The grammage of the heat resistant layer is 45% of the total grammage of the heat resistant layer and the liquid guiding layer. The total thickness of the heat resistant layer and the liquid guiding layer is 1.65 mm. The total grammage of the heat resistant layer and the liquid guiding layer is 250 g/m$^2$.

Example 8

This example provides a fiber composite material, and a preparation method thereof includes the following steps.

(1) 750 kg of polyimide fibers (2.0 D×51 mm), 50 kg of three-dimensional crimped hollow polyester fibers (5 D×60 mm), and 200 kg of Tencel fibers (1.5 D×38 mm) were fed into a coarse opener at a rotational speed of 1250 r/min, to pre-opening the lumpy crimped and compacted fibers. The pre-opened fibers were fed into a cotton mixing warehouse for mixing and then carded by cotton feeding rollers of a carding machine into a 5 g/m$^2$ mono-layer-fibrous web thin ply material. Multiple mono-layer-fibrous web thin ply materials were laid together to form a fibrous web material (with the thickness of 6 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 350 times/min, and the needling depth is 1.5 mm. In the backward needling process, the density of needles arranged on a needle plate is 4000 needles/m, the needling frequency is 390 times/min, and the needling depth is 1.9 mm. Finally, a semi-fabricated fibrous web for heat resistant layer was obtained.

(2) 950 kg of Tencel fibers (1.5 D×38 mm) and 50 kg of three-dimensional crimped hollow polyester fibers (5 D×60 mm) were fed into a coarse opener at a rotational speed of 1540 r/min, to pre-opening the lumpy crimped and compacted fibers. The pre-opened fibers were fed into a cotton mixing warehouse for mixing and then carded by cotton feeding rollers of a carding machine into a 10 g/m$^2$ mono-layer-fibrous web thin ply material. Multiple mono-layer-fibrous web thin ply materials were laid together to form a fibrous web material (with the thickness of 13 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 400 times/min, and the needling depth is 2.0 mm. In the backward needling process, the density of needles arranged on a needle plate is 4000 needles/m, the needling frequency is 450 times/min, and the needling depth is 2.5 mm. Finally, a semi-fabricated fibrous web for liquid guiding layer was obtained.

(3) The semi-fabricated fibrous web for heat resistant layer and the semi-fabricated fibrous web for liquid guiding layer were fed through double channels into a forward needling machine for repeated needling, and then fed into a backward needling machine for needling, so that the semi-fabricated fibrous web for heat resistant layer and the semi-fabricated fibrous web for liquid guiding layer were entangled and fixed together. In the step of forward needling, the density of needles arranged on a needle plate is 12000 needles/m, the needling frequency is 1200 times/min, and the needling depth is 1.5 mm. In the step of backward needling, the density of needles arranged on a needle plate is 14000 needles/m, the needling frequency is 1300 times/min, and the needling depth is 1.6 mm. Hot rolling was carried out by using a three-roller calender with a speed controlled to 20 m/min, a distance between rollers controlled to 0.9 mm, and a hot rolling temperature controlled to 180° C. After the hot rolling, the hot-rolled material was wound to form a coil to obtain the fiber composite material.

The fiber composite material prepared above includes a heat resistant layer and a liquid guiding layer that are stacked. The material of the heat resistant layer is the polyimide fiber, the Tencel fiber, and the three-dimensional crimped hollow polyester fiber. The material of the liquid guiding layer is the Tencel fiber and the three-dimensional crimped hollow polyester fiber. Based on the total weight of the material of the heat resistant layer, a weight proportion of the polyimide fiber is 75%, a weight proportion of the Tencel fiber is 20%, and a weight proportion of the three-dimensional crimped hollow polyester fiber is 5%. Based on the total weight of the material of the liquid guiding layer, a weight proportion of the Tencel fiber is 95%, and a weight proportion of the three-dimensional crimped hollow polyester fiber is 5%. The porosity of the heat resistant layer is 82%. The porosity of the liquid guiding layer is 63%. The thickness of the heat resistant layer is 30% of the total thickness of the heat resistant layer and the liquid guiding layer. The grammage of the heat resistant layer is 50% of the total grammage of the heat resistant layer and the liquid guiding layer. The total thickness of the heat resistant layer and the liquid guiding layer is 0.9 mm. The total grammage of the heat resistant layer and the liquid guiding layer is 180 g/m$^2$.

Example 9

This example provides a fiber composite material. Compared with Example 1, the difference lies in that 400 kg of polyimide fibers were replaced with 300 kg of polyimide fibers and 100 kg of polyphenylene sulfide fibers.

Example 10

This example provides a fiber composite material. Compared with Example 1, the difference lies in that 400 kg of polyimide fibers were replaced with 300 kg of polyimide fibers and 100 kg of PBO fibers.

Example 11

This example provides a fiber composite material. Compared with Example 1, the difference lies in that in step (2), 1000 kg of Tencel fibers were replaced with 800 kg of Tencel fibers and 200 kg of cotton fibers.

Example 12

This example provides a fiber composite material. Compared with Example 1, the difference lies in that in step (2), 1000 kg of Tencel fibers were replaced with 900 kg of Tencel fibers and 100 kg of flax fibers.

Example 13

This example provides a fiber composite material, and a preparation method thereof includes the following steps.

(1) 400 kg of polyimide fibers (0.89 D×60 mm) and 600 kg of Tencel fibers (0.9 D×60 mm) were fed into a coarse opener at a rotational speed of 1250 r/min, to pre-opening the lumpy crimped and compacted fibers. The pre-opened fibers were fed into a cotton mixing warehouse for mixing and then carded by cotton feeding rollers of a carding machine into a 10 g/m$^2$ monolayer-fibrous web thin ply material. Multiple monolayer-fibrous web thin ply materials were laid together to form a fibrous web material (with the thickness of 12 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 400 times/min, and the needling depth is 2.0 mm. In the backward needling process, the density of needles arranged on a needle plate is 4000 needles/m, the needling frequency is 440 times/min, and the needling depth is 2.4 mm. Finally, a semi-fabricated fibrous web for heat resistant layer was obtained.

(2) 1000 kg of Tencel fibers (0.9 D×60 mm) were fed into a coarse opener at a rotational speed of 1540 r/min, to pre-opening the lumpy crimped and compacted fibers. The pre-opened fibers were fed into a cotton mixing warehouse for mixing and then carded by cotton feeding rollers of a carding machine into a 20 g/m$^2$ monolayer-fibrous web thin ply material. Multiple monolayer-fibrous web thin ply materials were laid together to form a fibrous web material (with the thickness of 15 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 450 times/min, and the needling depth is 2.5 mm. In the backward needling process, the density of needles arranged on a needle plate is 4000 needles/m, the needling frequency is 500 times/min, and the needling depth is 3.0 mm. Finally, a semi-fabricated fibrous web for liquid guiding layer was obtained.

(3) The semi-fabricated fibrous web for heat resistant layer and the semi-fabricated fibrous web for liquid guiding layer were fed through double channels into a forward needling machine for repeated needling, and then fed into a backward needling machine for needling, so that the semi-fabricated fibrous web for heat resistant layer and the semi-fabricated fibrous web for liquid guiding layer were entangled and fixed together. In the step of forward needling, the density of needles arranged on a needle plate is 12000 needles/m, the needling frequency is 1200 times/min, and the needling depth is 1.3 mm. In the step of backward needling, the density of needles arranged on a needle plate is 14000 needles/m, the needling frequency is 1300 times/min, and the needling depth is 1.3 mm. Hot rolling was carried out by using a three-roller calender with a speed controlled to 20 m/min, a distance between rollers controlled to 1.3 mm, and a hot rolling temperature controlled to 180° C. After the hot rolling, the hot-rolled material was wound to form a coil to obtain the fiber composite material.

The fiber composite material prepared above includes a heat resistant layer and a liquid guiding layer that are stacked. The material of the heat resistant layer is the polyimide fiber and the Tencel fiber. The material of the liquid guiding layer is the Tencel fiber. Based on the total weight of the material of the heat resistant layer, a weight proportion of the polyimide fiber is 40%, and a weight proportion of the Tencel fiber is 60%. Based on the total weight of the material of the liquid guiding layer, a weight proportion of the Tencel fiber is 100%. The porosity of the heat resistant layer is 83%. The porosity of the liquid guiding layer is 73%. The thickness of the heat resistant layer is 45% of the total thickness of the heat resistant layer and the liquid guiding layer. The grammage of the heat resistant layer is 45% of the total grammage of the heat resistant layer and the liquid guiding layer. The total thickness of the heat resistant layer and the liquid guiding layer is 1.5 mm. The total grammage of the heat resistant layer and the liquid guiding layer is 250 g/m$^2$.

Example 14

This example provides a fiber composite material, and a preparation method thereof includes the following steps.

(1) 400 kg of polyimide fibers (0.89 D×60 mm) and 600 kg of Tencel fibers (0.9 D×60 mm) were fed into a coarse opener at a rotational speed of 1250 r/min, to pre-opening the lumpy crimped and compacted fibers. The pre-opened fibers were fed into a cotton mixing warehouse for mixing and then carded by cotton feeding rollers of a carding machine into a 10 g/m$^2$ monolayer-fibrous web thin ply material. Multiple monolayer-fibrous web thin ply materials were laid together to form a fibrous web material (with the thickness of 12 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 400 times/min, and the needling depth is 1.7 mm. In the backward needling process, the density of needles arranged on a needle plate is 4000 needles/m, the needling frequency is 440 times/min, and the needling depth is 2.1 mm. Finally, a semi-fabricated fibrous web for heat resistant layer was obtained.

(2) 1000 kg of Tencel fibers (0.9 D×60 mm) were fed into a coarse opener at a rotational speed of 1540 r/min, to pre-opening the lumpy crimped and compacted fibers. The pre-opened fibers were fed into a cotton mixing warehouse for mixing and then carded by cotton feeding rollers of a carding machine into a 20 g/m$^2$ monolayer-fibrous web thin ply material. Multiple monolayer-fibrous web thin ply materials were laid together to form a fibrous web material (with the thickness of 15 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 450 times/min, and the needling depth is 2.2 mm. In the backward needling process, the density of needles arranged on a needle plate is 4000 needles/m, the needling frequency is 500 times/min, and the needling depth is 2.7 mm. Finally, a semi-fabricated fibrous web for liquid guiding layer was obtained.

(3) The semi-fabricated fibrous web for heat resistant layer and the semi-fabricated fibrous web for liquid guiding layer were fed through double channels into a forward needling machine for repeated needling, and then fed into a backward needling machine for needling, so that the semi-fabricated fibrous web for heat resistant layer and the semi-fabricated fibrous web for liquid guiding layer were entangled and fixed together. In the step of forward needling, the density of needles arranged on a needle plate is 12000 needles/m, the needling frequency is 1200 times/min, and the needling depth is 1.3 mm. In the step of backward needling, the density of needles arranged on a needle plate is 14000 needles/m, the needling frequency is 1300 times/min, and the needling depth is 1.3 mm. Hot rolling was carried out by using a three-roller calender with a speed controlled to 20 m/min, a distance between rollers controlled to 1.3 mm, and a hot rolling temperature controlled to 180° C. After the hot rolling, the hot-rolled material was wound to form a coil to obtain the fiber composite material.

The fiber composite material prepared above includes a heat resistant layer and a liquid guiding layer that are stacked. The material of the heat resistant layer is the polyimide fiber and the Tencel fiber. The material of the liquid guiding layer is the Tencel fiber. Based on the total weight of the material of the heat resistant layer, a weight proportion of the polyimide fiber is 40%, and a weight proportion of the Tencel fiber is 60%. Based on the total weight of the material of the liquid guiding layer, a weight proportion of the Tencel fiber is 100%. The porosity of the heat resistant layer is 76%. The porosity of the liquid guiding layer is 82%. The thickness of the heat resistant layer is 40% of the total thickness of the heat resistant layer and the liquid guiding layer. The grammage of the heat resistant layer is 40% of the total grammage of the heat resistant layer and the liquid guiding layer. The total thickness of the heat resistant layer and the liquid guiding layer is 1.55 mm. The total grammage of the heat resistant layer and the liquid guiding layer is 250 g/m$^2$.

Comparative Example 1

This comparative example provides a fiber composite material. Compared with Example 1, the difference in the preparation method lies in that in step (1), no polyimide fibers were added, and 1000 kg of Tencel fibers were added.

Comparative Example 2

This comparative example provides a fiber composite material. Compared with Example 1, the difference in the preparation method lies in that in step (1), no Tencel fibers were added, and 1000 kg of polyimide fibers were added.

Comparative Example 3

This comparative example provides a fiber composite material. Compared with Example 1, the difference in the preparation method lies in that no liquid guiding layer was provided. The preparation method includes the following steps.

(1) 400 kg of polyimide fibers (2.0 D×51 mm) and 600 kg of Tencel fibers (1.5 D×38 mm) were fed into a coarse opener at a rotational speed of 1250 r/min, to pre-opening the lumpy crimped and compacted fibers. The pre-opened fibers were fed into a cotton mixing warehouse for mixing and then carded by cotton feeding rollers of a carding machine into a 10 g/m$^2$ mono-layer-fibrous web thin ply material. Multiple mono-layer-fibrous web thin ply materials were laid together to form a fibrous web material (with the thickness of 12 cm). The fibrous web material was sequentially fed into a pre-needling machine and a backward needling machine to carry out pre-needling and backward needling to entangle the fibrous web material for shaping. In the pre-needling process, the density of needles arranged on a needle plate is 3500 needles/m, the needling frequency is 400 times/min, and the needling depth is 1.7 mm. In the backward needling process, the density of needles arranged on a needle plate is 4000 needles/m, the needling frequency is 440 times/min, and the needling depth is 2.1 mm. Finally, a semi-fabricated fibrous web for heat resistant layer was obtained.

(2) The semi-fabricated fibrous web for heat resistant layer was fed into a forward needling machine for repeated needling, and then fed into a backward needling machine for needling. In the step of forward needling, the density of needles arranged on a needle plate is 12000 needles/m, the needling frequency is 1200 times/min, and the needling depth is 1.3 mm. In the step of backward needling, the density of needles arranged on a needle plate is 14000 needles/m, the needling frequency is 1300 times/min, and the needling depth is 1.3 mm. Hot rolling was carried out by using a three-roller calender with a speed controlled to 20 m/min, a distance between rollers controlled to 1.3 mm, and a hot rolling temperature controlled to 180° C. After the hot rolling, the hot-rolled material was wound to form a coil to obtain the fiber composite material.

Test Example 1

The fiber composite materials obtained in the foregoing examples were separately tested for the average pore size and the porosity.

Test for average pore size: The fiber composite material was cut into five circular samples with a 1.5 cm diameter. After fully soaked in a surfactant GQ16 (from Nanjing Gaoqian Functional Materials Technology Co., Ltd., surface tension: $16\times10^{-3}$ N/m) for 30 min, the circular samples were placed face-up into a test cell of a capillary flow porometer, prior to capping on tight. Then, the test was carried out (with one sample each time) for an average pore size of each sample. Test results of the five samples were averaged.

Test for porosity: By using a n-butanol impregnation method, the fiber composite material dried to a constant weight was weighed $m_0$, then immersed in n-butanol (analytical reagent) for 12 h, and then taken out. The fiber composite material was wiped with a filter paper to absorb the liquid on its front and back surfaces, and then weighed $m_1$. The porosity of the fiber composite material was calculated. $\delta=(m_1-m_0)/\rho V\times100\%$. $\delta$ is the porosity, $\rho$ is the density of n-butanol, and V is the apparent volume of the fiber composite material.

The test result is shown in Table 1.

TABLE 1

| | Average pore size (μm) | Porosity (%) |
|---|---|---|
| Example 1 | 54 | 68 |
| Example 2 | 48 | 62 |
| Example 3 | 55 | 71 |
| Example 4 | 59 | 74 |
| Example 5 | 63 | 79 |
| Example 6 | 70 | 90 |
| Example 7 | 65 | 81 |
| Example 8 | 57 | 73 |
| Example 9 | 54 | 70 |
| Example 10 | 54 | 69 |
| Example 11 | 56 | 72 |
| Example 12 | 57 | 74 |
| Example 13 | 42 | 78 |
| Example 14 | 54 | 80 |

Test Example 2

The fiber composite materials obtained in the foregoing examples and comparative examples were separately tested for the liquid storage performance, the liquid locking performance, and the liquid guiding performance.

Test for Liquid Storage Performance

The fiber composite material was cut into four pieces of 7 mm×60 mm, and then placed in a standard environment (temperature 20° C., relative humidity 65%) to balance for 24 h. Each of the four pieces was weighed, compressed by using a jig to a specific thickness (1.1 mm), soaked in an e-liquid (apple e-liquid: nicotine: 0 mg, solvent: propylene glycol and glycerol in a volume ratio of 50/50) for 50 min, and then taken out and hung up to drain the e-liquid for 10 min. The fiber composite material was slowly taken out of the jig and weighed. The liquid storage performance per unit mass of the fiber composite material was calculated based on a mass difference and then averaged in a unit of g/g, which indicates the mass of e-liquid stored in the fiber composite material per gram.

Test for Liquid Locking Performance

The fiber composite material was cut into four pieces of 7 mm×60 mm, and then placed in a standard environment (temperature 20° C., relative humidity 65%) to balance for 24 h. Each of the four pieces was weighed, compressed by using a jig to a specific thickness (1.1 mm), soaked in an e-liquid (apple e-liquid: nicotine: 0 mg, solvent: propylene glycol and glycerol in a volume ratio of 50/50) for 50 min, and then taken out and hung up to drain the e-liquid for 10 min. The jig was centrifuged in a freeze-drying centrifuge (at 20° C. at 500 r/min) for 15 min, and then taken out. The fiber composite material was slowly taken out of the jig and weighed. The liquid locking performance per unit mass of the fiber composite material was calculated based on a mass difference and then averaged in a unit of g/g, which indicates the mass of e-liquid locked in the fiber composite material per gram.

Test for Liquid Guiding Performance

The fiber composite material was cut into four pieces of 7 mm×60 mm, and then placed in a standard environment (temperature 20° C., relative humidity 65%) to balance for 24 h. Each of the four pieces was compressed by using a jig to a specific thickness (1.1 mm), and the jig was vertically hung in a liquid-guiding tester. 10 ml of e-liquid (apple e-liquid: nicotine: 0 mg, solvent: propylene glycol and glycerol in a volume ratio of 50/50) was placed on a platform of the liquid-guiding tester. The platform was slowly raised until a lower end of the jig touches the e-liquid. As soon as the platform stopped rising, time counting was started. The fiber composite material actively absorbs the e-liquid through a capillary effect and e-liquid affinity, and continues to increase in the weight over time. The change of weight of the fiber composite material at 100 s was recorded and averaged to obtain the liquid guiding performance of the fiber composite material in a unit of g/100 s, which indicates the mass of e-liquid guided by the fiber composite material at 100 s.

The test result is shown in Table 2.

TABLE 2

| | Liquid storage performance (g/g) | Liquid locking performance (g/g) | Liquid guiding performance (g/100 s) |
|---|---|---|---|
| Example 1 | 4.90 | 2.98 | 0.3796 |
| Example 2 | 4.29 | 2.57 | 0.3104 |
| Example 3 | 5.06 | 3.15 | 0.3824 |
| Example 4 | 5.57 | 3.41 | 0.4237 |
| Example 5 | 5.90 | 3.64 | 0.4461 |
| Example 6 | 6.13 | 3.77 | 0.4996 |
| Example 7 | 5.49 | 3.38 | 0.4452 |
| Example 8 | 5.04 | 3.03 | 0.3974 |
| Example 9 | 4.86 | 2.95 | 0.3601 |
| Example 10 | 4.81 | 2.84 | 0.3603 |
| Example 11 | 5.14 | 3.07 | 0.3954 |
| Example 12 | 5.27 | 3.25 | 0.4101 |
| Example 13 | 5.32 | 3.58 | 0.4226 |
| Example 14 | 5.30 | 3.69 | 0.4426 |
| Comparative Example 1 | 5.24 | 3.35 | 0.2904 |
| Comparative Example 2 | 2.26 | 1.31 | 0.1325 |
| Comparative Example 3 | 3.07 | 2.05 | 0.2174 |

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A fiber composite material, comprising:

a heat resistant layer and a liquid guiding layer that are stacked, wherein a material of the heat resistant layer comprises a heat resistant fiber and a first hydrophilic fiber, wherein a material of the liquid guiding layer comprises a second hydrophilic fiber, wherein the heat resistant fiber comprises a polyimide fiber, wherein the first hydrophilic fiber and the second hydrophilic fiber each comprise a lyocell fiber, and wherein, based on a total weight of the material of the liquid guiding layer, a weight proportion of the second hydrophilic fiber is 100%.

2. A heating assembly, comprising:

a fiber composite material comprising a heat resistant layer and a liquid guiding layer that are stacked; and a heating body in contact with the heat resistant layer, wherein a material of the heat resistant layer comprises a heat resistant fiber and a hydrophilic fiber, wherein a material of the liquid guiding layer comprises a hydrophilic fiber, and wherein the heat resistant fiber comprises a polyimide fiber.

3. The heating assembly of claim 2, wherein the material of the heat resistant layer and/or liquid guiding layer comprises a high resilience fiber.

4. The heating assembly of claim 3, wherein the high resilience fiber comprises a hollow polyester fiber.

5. The heating assembly of claim 3, wherein the heat resistant fiber further comprises at least one of a polyphenylene sulfide fiber, an aramid fiber, a polytetrafluoroethylene fiber, a carbon fiber, a metal fiber, a poly(p-phenylene-2,6-benzobisoxazole) fiber, and a poly[2,2'-(m-phenylen)-5,5'-bisbenzimidazole] fiber, wherein the hydrophilic fiber of the heat resistant layer and the hydrophilic fiber of the liquid guiding layer each further comprises at least one of a cotton fiber, a flax fiber, a hemp fiber, a Modal fiber, a cuprammonium rayon fiber, a bamboo fiber, a seaweed fiber, a chitosan fiber, and a carboxymethyl cellulose fiber, wherein, based on a total weight of the material of the heat resistant layer, a weight proportion of the heat resistant fiber is 19.9-80%, a weight proportion of the hydrophilic fiber of the heat resistant layer is 19.9-80%, and a weight proportion of the high resilience fiber is 0.1-20%, and wherein, based on a total weight of the material of the liquid guiding layer, a weight proportion of the hydrophilic fiber of the liquid guiding layer is 50-99.9%, and a weight proportion of the high resilience fiber is 0.1-50%.

6. The heating assembly of claim 3, wherein a porosity of the heat resistant layer is 70-98%, and a porosity of the liquid guiding layer is 50-82%, wherein, based on a total weight of the material of the heat resistant layer, a weight proportion of the heat resistant fiber is 20-60%, a weight proportion of the hydrophilic fiber is 20-60%, and a weight proportion of the high resilience fiber is 10-20%, and wherein, based on a total weight of the material of the liquid guiding layer, a weight proportion of the hydrophilic fiber is 80-90%, and a weight proportion of the high resilience fiber is 10-20%.

7. The heating assembly of claim 2, wherein a thickness of the heat resistant layer is 30-60% of a total thickness of the heat resistant layer and the liquid guiding layer, wherein a grammage of the heat resistant layer is 30-60% of a total grammage of the heat resistant layer and the liquid guiding layer, and wherein the total thickness of the heat resistant layer and the liquid guiding layer is 0.9-1.8 mm, and the total grammage of the heat resistant layer and the liquid guiding layer is 180-300 g/m$^2$.

8. The heating assembly of claim 3, wherein a length of the heat resistant fiber is 38-60 mm, a fineness of the heat resistant fiber is 0.8-7.0 D, a length of the hydrophilic fiber of the heat resistant layer and the hydrophilic fiber of the liquid guiding layer each is 28-60 mm, a fineness of the hydrophilic fiber of the heat resistant layer and the hydrophilic fiber of the liquid guiding layer each is 0.9-2.5 D, a length of the high resilience fiber is 38-60 mm, and a fineness of the high resilience fiber is 3-10 D.

9. The heating assembly of claim 2, wherein a length of the heat resistant fiber is 50-60 mm, a fineness of the heat resistant fiber is 0.8-1 D, a length of the hydrophilic fiber of the heat resistant layer and the hydrophilic fiber of the liquid guiding layer each is 50-60 mm, and a fineness of the hydrophilic fiber of the heat resistant layer and the hydrophilic fiber of the liquid guiding layer each is 0.9-1.0 D.

10. A preparation method of the heating assembly of claim 2, comprising:

preparing the fiber composite material using a needling process.

11. The method of claim 10, further comprising:

(1) opening, mixing, and carding a material of the heat resistant layer to obtain a mono-layer-fibrous web thin ply material, laying a plurality of mono-layer-fibrous web thin ply materials together to form a fibrous web material, and needling the fibrous web material to entangle fibers for shaping, to obtain a semi-fabricated fibrous web for heat resistant layer;

(2) opening, mixing, and carding a material of the liquid guiding layer to obtain a mono-layer-fibrous web thin ply material, laying a plurality of mono-layer-fibrous web thin ply materials together to form a fibrous web material, and needling the fibrous web material to entangle fibers for shaping, to obtain a semi-fabricated fibrous web for liquid guiding layer; and (3) bonding the semi-fabricated fibrous web for heat resistant layer and the semi-fabricated fibrous web for liquid guiding layer together by needling, and carrying out hot rolling, to obtain the fiber composite material.

12. The method of claim 11, wherein, in step (1), a grammage of the mono-layer-fibrous web thin ply material is 5-20 g/m$^2$, a thickness of the fibrous web material is 4-15 cm, the step of needling to entangle fibers for shaping comprises sequentially carrying out a pre-needling process and a backward needling process on the fibrous web material, wherein, in step (2), the grammage of the mono-layer-fibrous web thin ply material is 10-30 g/m$^2$, the thickness of the fibrous web material is 11-16 cm, the step of needling to entangle fibers for shaping comprises sequentially carrying out a pre-needling process and a backward needling process on the fibrous web material; and wherein, in step (3), the step of needling comprises a step of forward needling and a step of backward needling;

wherein the hot rolling is carried out using a three-roller calender with a speed controlled to 20-50 m/min, a distance between rollers controlled to 0.9-1.8 mm, and a hot rolling temperature controlled to 160-180° C. and wherein, step (3) further comprises winding the fiber composite material to form a coil, after the hot rolling.

13. A liquid guiding element, wherein a material of the liquid guiding element comprises:

a fiber composite material comprising: a heat resistant layer and a liquid guiding layer that are stacked, wherein a material of the heat resistant layer comprises a heat resistant fiber and a first hydrophilic fiber, wherein a material of the liquid guiding layer comprises a second hydrophilic fiber, wherein the heat resistant fiber comprises a polyimide fiber, and wherein the first hydrophilic fiber and the second hydrophilic fiber each comprises a lyocell fiber, or the fiber composite material obtained using the method of claim 10.

14. The heating assembly of claim 2, wherein, based on a total weight of the material of the heat resistant layer, a weight proportion of the heat resistant fiber is 20-80%, and a weight proportion of the hydrophilic fiber is 20-80%.

15. A vaporizer, comprising:

the heating assembly of claim 2.

16. An electronic vaporization device, comprising:

the vaporizer of claim 15.

17. The heating assembly of claim 4, wherein the hollow polyester fiber comprises a three-dimensional crimped hollow polyester fiber.

18. The method of claim 12, wherein, in step (1), in the pre-needling process, a density of needles arranged on a needle plate is 2000-4000 needles/m, a needling frequency is 350-450 times/min, and a needling depth is 1.5-2.0 mm; and in the backward needling process, the density of needles arranged on a needle plate is 3000-5000 needles/m, the needling frequency is 390-500 times/min, and the needling depth is 1.9-2.5 mm, wherein, in step (2), in the pre-needling process, the density of needles arranged on a needle plate is 2000-4000 needles/m, the needling frequency is 400-500 times/min, and the needling depth is 2.0-2.5 mm; and in the backward needling process, the density of needles arranged on a needle plate is 3000-5000 needles/m, the needling frequency is 450-550 times/min, and the needling depth is 2.5-3.0 mm, and wherein, in step (3), in the step of forward needling, the density of needles arranged on a needle plate is 10000-15000 needles/m, the needling frequency is 1000-1400 times/min, and the needling depth is 1.0-2.0 mm; and in the step of backward needling, the density of needles arranged on the needle plate is 12000-16000 needles/m, the needling frequency is 1000-1400 times/min, and the needling depth is 0.9-2.5 mm.

* * * * *